United States Patent [19]

Kozacka

[11] 4,093,932

[45] June 6, 1978

[54] ELECTRIC ALL PURPOSE FUSE

[75] Inventor: Frederick J. Kozacka, South Hampton, N.H.

[73] Assignee: Gould Inc., Rolling Meadows, Ill.

[21] Appl. No.: 775,248

[22] Filed: Mar. 7, 1977

[51] Int. Cl.[2] ..... H01H 85/04; H01H 85/12

[52] U.S. Cl. ..... 337/161; 337/159; 337/293

[58] Field of Search ..... 337/161, 162, 158, 159, 337/292, 293

[56] References Cited

U.S. PATENT DOCUMENTS

| | | | |
|---|---|---|---|
| 3,735,317 | 5/1973 | Jacobs, Jr. | 337/161 |
| 3,810,062 | 5/1974 | Kozacka | 337/161 |
| 3,843,948 | 10/1974 | Kozacka | 337/161 |
| 3,881,161 | 4/1975 | Kozacka | 337/161 |
| 3,969,694 | 7/1976 | Kozacka | 337/161 |

*Primary Examiner*—Harold Broome
*Attorney, Agent, or Firm*—Erwin Salzer

[57] ABSTRACT

In fuses for a sufficiently elevated circuit voltage the single breaks formed near the center of the fusible element at the occurrence of small overload currents does not produce a sufficiently high arc voltage to bring the current down to zero. In such instances it is necessary to produce series multibreaks to achieve interruption of the overloaded circuit.

The present invention describes new means to produce series multibreaks. In fuses according to this invention the fusible element is subdivided into a plurality of spaced elements in parallel to reduce the concentration of metal vapors. Each of the element forms a break near the center thereof. This occurs at different times $t_1$, $t_2$, $t_3$, etc. even though the elements are identical. Each break-formation is accompanied by a concomitant increase of current in the remaining fusible elements, and each break-formation is accompanied by a concomitant voltage spike or voltage surge — L(*di/dt*). These voltage surges are used to form series breaks in the fusible elements by spacing the constituent windings thereof so that a breakdown between windings may occur. The breakdown is, or may be said to be, a kind of Townsend discharge or spark rather than an arc discharge, i.e. a low current rather than a high current discharge.

4 Claims, 2 Drawing Figures

ELECTRIC ALL PURPOSE FUSE

BACKGROUND OF THE INVENTION

This invention relates to electric fuses having an elevated voltage rating, e.g. a rating of 2.8 to 23 Kv. It relates more specifically to fuses whose dimensions are drastically reduced as set forth below in more detail.

The invention solves the problem of providing all purpose fuses having extremely small dimensions, i.e. fuses capable of interrupting very small overloads requiring 1 hr to cause fusion of the fusible element or elements thereof (ANSI Standard C 37.40-2.2.2.2).

A solution to the problem of enabling fuses to interrupt the entire wide spectrum of currents which may occur is disclosed in my U.S. Pat. No. 3,810,062, May 7, 1974 for *HIGH-VOLTAGE FUSE HAVING FULL RANGE CLEARING ABILITY.* The solution shown in that patent has limitations. The fuses cannot be miniaturized to the required extent. The beads of melamine resin wth inorganic fillers are relatively bulky and expensive and it requires particular care to maintain equidistance between the turns of the windings of the fusible elements if they are carrying beads and if their number exceeds two.

In order to adapt fuses for the interruption of very small currents it is necessary to cause series miltibreaks in each of the fusible elements. Fuses wherein small currents are caused to be interrupted by series multibreaks in the fusible element, or elements thereof are disclosed in U.S. Pat. No. 3,735,317, 05/22/73 to P. C. Jacobs for ELECTRIC MULTIBREAK FORMING CARTRIDGE FUSE, and in my patent 3,969,694, 7/13/76 for ELECTRIC FUSE FOR ELEVATED CIRCUIT VOLTAGES CAPABLE OF INTERRUPTING SMALL OVERLOAD CURRENTS, and in other printed publications. These solutions require auxiliary circuitry for severing the fusible element, or elements, at several points and are, for this reason, not sufficiently cost-effective.

The present invention eliminates the drawbacks inherent in prior art solutions to the problem at hand.

SUMMARY OF THE INVENTION

Fuses embodying this invention include a tubular casing of electric insulation smaller than normal, i.e. having a length of 8–15 inches depending upon the voltage rating thereof. The ends of said casing are closed by a pair of terminal elements and filled with a granular quartz filler. A plurality of equal, wire-like fusible elements whose cross-sectional area changes periodically conductively interconnects said pair of terminal elements. The wire-like fusible elements are stampings of sheet metal. By subdividing the current path into wire-like strips of sheet metal the density of metal vapor that may occur at any point of the fuse is greatly reduced. Said plurality of fusible elements is wound substantially helically around a fusible element support which comprises rods of gas evolving insulating material, i.e. material evolving a gas under the action of an electric arc.

Fusion near the center of each conductor causes formation of an initial break in each of them, the fusion of the individual conductors occuring at a relatively rapid sequence. The formation of each break is accompanied by a significant voltage surge or voltage kick equal to $-L\ (di/dt)$. This voltage kick is significant because it results from a significant rate of change of current flow in the presence of more or less inductance. The axial spacing of said plurality of fusible elements is so narrow that said voltage kicks or spikes cause electric breakdowns between contiguous windings of said fusible element and formation of series breaks therein. On the other hand, the pitch or axial spacing between the conductors is sufficiently wide to preclude self-sustaining discharges between the constituent elements of the winding.

Figure 1:
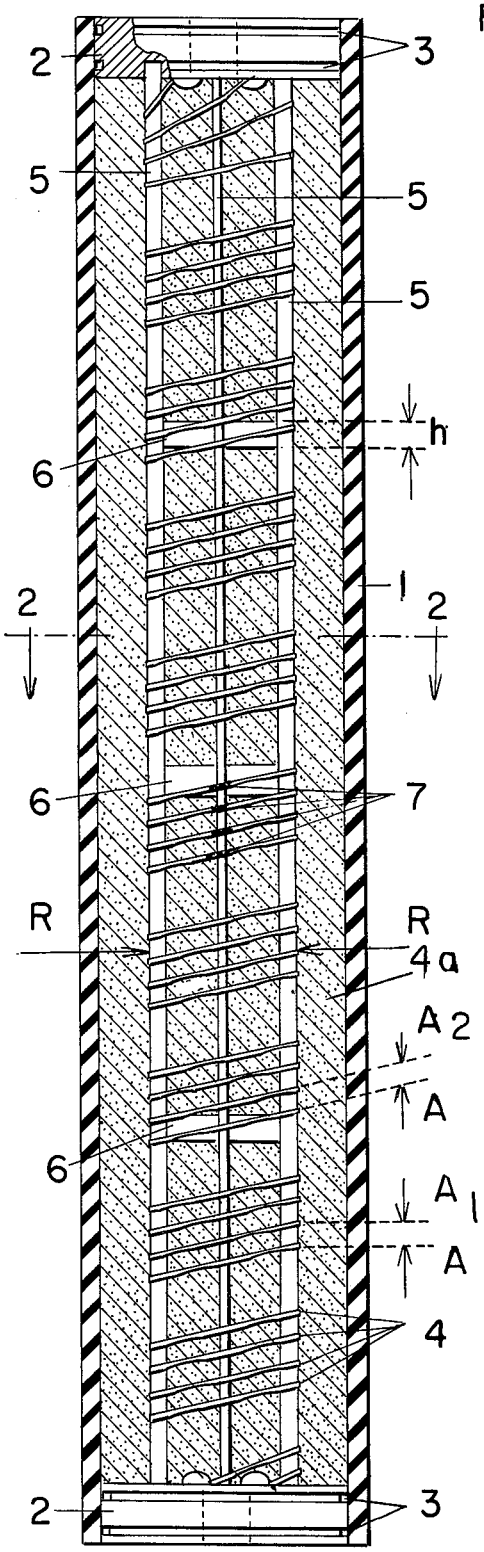
FIG. 1 is substantially an elevational view of a fuse embodying this invention showing portions thereof in cross-section rather than in elevation.
Figure 2:
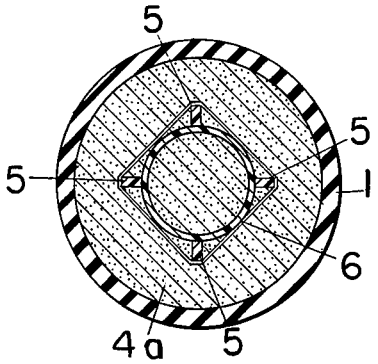
FIG. 2 is a section along 2—2 of FIG. 1.

DESCRIPTION OF PREFERRED EMBODIMENTS.

In the drawings numeral 1 has been applied to indicate a tubular casing of electric insulation, e.g. glass-cloth-melamin laminate. The casing has a length of 8–15 inches depending upon the voltage rating of the particular fuse. The table below indicates approximate casing length depending upon voltage rating.

| Max kV | Approximate casing length |
|---|---|
| 5.5 | 8.15" |
| 8.3 | 8.15" |
| 15.5 | 12.41" |
| 23.0 | 15.36" |

Reference numeral 2 has been applied to indicate a pair of plug terminals closing the ends of casing 1. The O.D. of plug terminals is somewhat less than the I.D. of casing 2. O-rings 3 of an elastomer are inserted between casing 1 and plug terminals 2. The I.D. of casing 1 changes with the current-rating of the fuse. It is, for instance, 2 inches for a fuse rated at 15 kV and 200 A, and decreases with decreasing current rating. Four wire-like fusible elements 4 inter-connect plugs 2, thus maximizing the interface between the metal vapors resulting from the vaporization of elements 4 and the surrounding quartz filler 4*a*. The cross-sectional area of fusible elements 4 changes periodically to limit voltage surges resulting from their vaporization. Elements 4 are sheet metal stampings which are much easier to manufacture than wires.

It is important that the current be carried by a relatively large number of wire-like current paths, as contrasted with fusible elements in the shape of a ribbon. In the 15 kV embodiment of the invention shown, the fusible elements vary between 0.031 inch and 0.023 inch and have 101 points of narrowest cross-section. The fusible elements are blanked or stamped out of sheet metal having a thickness of 0.012 inch. If the fuse rating is decreased, a thinner sheet of silver may be used for stamping out the fusible elements.

As mentioned above, fusible elements 4 are wound substantially helically around four rods 5 of a gas-evolving material, e.g. a material including melamin resin. Rods 5 are so thin as to be incapable of withstanding without intolerable bending the lateral thrust R exerted by the fusible elements 4. A plurality of annular braces 6 impart to rods 5 the bending strength, or stiffness, required to support fusible elements 4. The ends of rods 5 are arranged in a circle whose diameter is slightly exceeded by the O.D. of annular braces 6 so that rods 5 are slightly bent outwardly or pre-stressed by braces 6. Braces 6 are cemented to rods 5 so that braces 6 and rods 5 form an integral structure. An important feature of braces 5 resides in the fact that they are cylindrical, their length 1 by far exceeding their radial width, i.e. the difference between their O.D. and their I.D.

A plurality of low-fusing point fusible-element-severing overlays 7, e.g. of tin, is arranged approximately at the center region of each of fusible elements 4. These overlays cause at the occurrence of small overload currents by a metallurgical reaction between the base metal and the overlay metal fusion and formation of initial breaks. Formation of these breaks occurs at a relatively rapid sequence. The voltage kick or surge voltage associated with these breaks is sufficiently high to cause electric breakdown between contiguous windings of the fusible element. The breakdowns cause formation of additional breaks in the fusible elements 4, i.e. formation of series breaks in addition to those initially formed at the points 7 where the low fusing point overlays are located.

What occurs between contiguous windings of the fusible elements depends inter alia upon the spacing between the windings which can be measured either by the spacing between parallel turns $A-A_1$ or the axial spacing $A-A_2$. If that spacing is relatively large, a phenomenon called "trigging" will occur, i.e. each break formation at an overlay 7 will increase the current to be carried by the parallel fusible elements 4 which are still intact, thus causing formation of one break in each of the fusible elements in a relatively rapid sequence. This will occur when, and as long as, $A-A_1 = X$ or $A-A_2 = X'$. If the above spacings (or distances) are drastically reduced, contiguous windings of the fuse merge upon blowing thereof into one integral fulgurite, i.e. the fuse fails practically, or entirely.

There is a critical spacing where the dielectric breakdown between contiguous windings occurs, but where the breakdown is not followed by an arc discharge or self-sustained discharge across the breakdown gap. The electric breakdown which occurs subsequently at random points of the fusible element 4 however damages contiguous windings to such an extent that the points where the breakdown occurs results in increased $i^2 \cdot r$ losses, and in formation of breaks at these points.

It should be understood that the discovery of a critical distance or spacing between contiguous turns is the most important, but only one, of the prerequisites for success. If, for instance, formation of initial breaks at the point 7 would occur sequentially, and the correct voltage spikes $-L\,(di/dt)$ generated which cause a non-self-sustained low current discharge, the fuse might fail at high currents if the interface between the fusible elements 4 and their gas-evolving support is too large.

Fulgurites resulting from blowing of fuses according to this invention fully confirm the above theory of operation, and in particular the formation of series multibreaks, each fulgurite being separated from the contiguous fulgurite by a layer of sound, i.e. not fused, sand particles.

Fuses according to this invention are primarily intended for the protection of distribution transformers. The overlays 7 or "M spots" reduce the fusing current from about 960° C to about 300° C. Once fusion is initiated the sequential formation of additional initial breaks and series breaks occurs in rapid sequence.

The current rating of fuses according to this invention is the so-called "C" rating. See American National Standard Distribution Fuse Disconnecting Units C 37.47. To be more specific, according to paragraph 47-3.1 of that standard the fusible or current responsive element of such fuses shall melt in 1000 seconds at an rms current within the range of 170 to 240 percent of the continuous current rating of the fuse unit.

Regarding the geometry of the fusible elements, the same conforms to the geometry shown in my U.S. Pat. No. 3,810,062 (see FIG. 3 thereof), 5/7/74 for HIGH-VOLTAGE FUSE HAVING FULL RANGE CLEARING ABILITY, except for the fact that fusible elements according to the present invention have a smaller cross-section so that they appear to be wires rather than ribbons, and perform like wires, rather than ribbons. FIG. 1 clearly shows one edge of eac fusible element to be straight and the opposite edge to be scalloped.

It is possible to distinguish between various kinds of electric gas discharges, such as spark-discharges, corona discharges, etc. Gas discharges are generally divided into two groups, those which are self-sustaining and those which are not self-sustaining. A spark discharge is a transition from a non-self-sustaining discharge to a self-sustaining discharge. The electric arc is a self-sustained discharge having a low voltage drop and high current discharge. With this terminology in mind, the discharge which takes place in the subject-matter of the present invention is a spark discharge. An electric arc or high current discharge would result in a short-circuit between contiguous turns of the fusible elements by formation of a fulgurite between contiguous turns. Such fulgurite would short-circuit parallel current paths established by the several fusible elements and be considered not as an embodiment of the present invention, but as a malperforming fuse.

For further details in regard to the critical gaps, reference may be had to the book of James D. Cobine, Gaseous Conductors, 5 ed., McGraw Hill Book Company, New York and London 1941, particularly page 143 and following "Field-Intensified Ionization and Breakdown of Gases".

Referring to fuses according to this invention blown on a small currents, such fuses may show four fulgurites extending from the center of the fusible element to the right. These fulgurites are initiated in the center region of the fusible element and formed by arcing from left to right. A separate breakdown may occur immediately adjacent the right terminal. Two other breakdowns may occur to the left of the center of the fusible elements. The breakdown zones are apparent from the fulgurites which formed therein and which are separated from one another by portions of sound fusible elements.

I claim as my invention:

1. A miniature fuse for elevated voltages calling for series multibreaks for the interruption of small overload currents comprising (a) a tubular casing of electric insulating material having a length of about 8–15 inches;

(b) a pair of terminal elements closing the ends of said casing;

(c) a granular quartz filler inside said casing;

(d) a plurality of wire-like fusible elements whose cross-sectional area changes periodically conductively interconnecting said pair of terminal elements, said plurality of fusible elements being stampings of sheet metal;

(e) a fusible element support around which said fusible elements are wound substantially helically, said support comprising rods of gas-evolving insulating material; and (f) the spacing of said plurality of fusible elements being such that initial break formation near the center of said plurality of fusible elements is followed by voltage surges and concomitant electric breakdowns between windings of said plurality of fusible elements and hence formation of series breaks without shortcircuiting and formation of a self-sustained electric discharge between said plurality of fusible elements.

2. A fuse as specified in claim 1 wherein the bending strength of said rods is too small for the lateral thrust exerted by said plurality of fusible elements, and wherein the required bending strength of said rods is achieved by a plurality of braces formed by cylinders whose radial width is small in comparison to the height thereof.

3. A miniature fuse for voltages calling for series multibreaks for the interruption of low overload currents comprising (a) a tubular casing having a length of less than 16 inches;

(b) a pair of terminal plugs closing the ends of said casing;

(c) a granular quartz sand filler inside said casing;

(d) a plurality of parallel connected fusible elements conductively interconnecting said pair of terminal plugs, each of said plurality of fusible elements consisting of a helically wound scalloped sheet metal so narrow as to be of wire-like appearance;

(e) rods of an insulating material evolving gas under the heat of electric arcs having ends affixed to the axially inner sides of said terminal plugs, said rods being so thin as to bend radially inwardly under the lateral pressure exerted upon them by said plurality of fusible elements and thus being incapable as such to form a support for said plurality of fusible elements;

(f) a plurality of cylindrical braces whose height exceeds the radial width thereof, said braces being arranged on the radially inner sides of said rods and stiffening said rods to such an extent as to be capable of withstanding the lateral pressure exerted upon them by said plurality of fusible elements;

(g) a plurality of overlays of a metal having a lower melting point than the base metal of which said plurality of fusible elements is made and capable by a metallurgical reaction to reduce the temperature at which said plurality of fusible elements is severed, each of said plurality of fusible elements being arranged approximately in the center of one of said plurality of fusible elements; and (h) the spacing of said plurality of fusible elements being such as to preclude any self-sustained discharge between the constituent fusible elements thereof but being small enough to allow a flashover between windings of said plurality of fusible elements and consequent increase of the resistivity thereof.

4. A miniature fuse for voltages in the order of 15 kV and currents in the order of 200 A comprising (a) a tubular casing of electric insulating material having a length of about 15 inches and a diameter of about 2 inches;

(b) a pair of terminal plugs closing the ends of said casing;

(c) a granular filler of quartz sand inside said casing;

(d) four wire-like helically wound fusible elements having a scalloped profile conductively interconnecting said pair of terminal elements;

(e) a squirrel-cage-like fusible element support of electric insulating material arranged between the axially inner end surfaces of said pair of terminal plugs, said element support including rods of a material evolving gas under the heat of electric arcs and a plurality of cylindrical braces whose height exceeds their width in radial direction arranged in planes transversely to said rods, said rods being so thin as to be incapable of withstanding the lateral thrust exerted by said fusible elements and being stiffened by said braces so as to withstand said thrust;

(f) four M-effect spots each positioned adjacent the center region of one of said four fusible elements, said M-effect spots causing formation of one break in each of said fusible elements; and (g) the axial spacing of said fusible elements being sufficiently narrow to cause at low overload currents an electric flashover between said fusible elements and consequent formation of series breaks therein, but said spacing being sufficiently wide to preclude a self-sustained discharge between said elements and merger of contiguous elements into one fulgurite.

* * * * *